US007961166B2

(12) United States Patent
Kim

(10) Patent No.: US 7,961,166 B2
(45) Date of Patent: Jun. 14, 2011

(54) LIQUID CRYSTAL DISPLAY DEVICE, DRIVING APPARATUS THEREOF AND DRIVING METHOD THEREOF

(75) Inventor: Hyeong Seok Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 810 days.

(21) Appl. No.: 11/452,384

(22) Filed: Jun. 14, 2006

(65) Prior Publication Data

US 2007/0001966 A1 Jan. 4, 2007

(30) Foreign Application Priority Data

Jun. 30, 2005 (KR) ..... 10-2005-0058420

(51) Int. Cl.
*G09G 3/36* (2006.01)

(52) U.S. Cl. ..... 345/96

(58) Field of Classification Search ..... 345/87–107
See application file for complete search history.

(56) References Cited

U.S. PATENT DOCUMENTS

| | | | | |
|---|---|---|---|---|
| 5,122,790 | A * | 6/1992 | Yasuda et al. | 345/96 |
| 6,040,814 | A * | 3/2000 | Murakami et al. | 345/96 |
| 6,075,505 | A * | 6/2000 | Shiba et al. | 345/87 |
| 6,496,172 | B1 * | 12/2002 | Hirakata | 345/96 |
| 7,088,328 | B2 * | 8/2006 | Inada et al. | 345/96 |
| 7,180,488 | B2 * | 2/2007 | Hirakata | 345/87 |
| 7,362,299 | B2 * | 4/2008 | Hosotani | 345/96 |
| 7,446,746 | B2 * | 11/2008 | Bu et al. | 345/96 |
| 2003/0043105 | A1 * | 3/2003 | Hirakata | 345/96 |
| 2003/0090450 | A1 * | 5/2003 | Inada et al. | 345/87 |
| 2004/0070581 | A1 | 4/2004 | Hiraki et al. | |
| 2004/0178980 | A1 | 9/2004 | Rao et al. | |
| 2004/0239602 | A1 * | 12/2004 | Kim et al. | 345/87 |
| 2005/0001829 | A1 | 1/2005 | Bu et al. | |
| 2005/0012733 | A1 | 1/2005 | Rao et al. | |
| 2005/0093806 | A1 * | 5/2005 | Hosotani | 345/96 |
| 2005/0104834 | A1 | 5/2005 | Tsuchihashi | |

FOREIGN PATENT DOCUMENTS

KR 1020040069920 8/2004

* cited by examiner

*Primary Examiner* — Chanh Nguyen
*Assistant Examiner* — Adam J Snyder
(74) *Attorney, Agent, or Firm* — McKenna Long & Aldridge LLP

(57) ABSTRACT

A liquid crystal display device including a liquid crystal display panel in which data lines and gate lines cross and a plurality of liquid crystal cells are arranged; a data discrimination part to detect data in which a dominant polarity is generated; a data driver to shift a polarity of the data in which the dominant polarity is generated in a horizontal direction and to supply the data to the data lines; and a gate driver to sequentially supply a scanning signal to the gate lines.

12 Claims, 7 Drawing Sheets

FIG. 2A
RELATED ART

| | | | | | | | |
|---|---|---|---|---|---|---|---|
| + | + | − | − | + | + | − | − |
| − | − | + | + | − | − | + | + |
| + | + | − | − | + | + | − | − |
| − | − | + | + | − | − | + | + |
| + | + | − | − | + | + | − | − |
| − | − | + | + | − | − | + | + |
| + | + | − | − | + | + | − | − |
| − | − | + | + | − | − | + | + |

FIG.2B
RELATED ART

| | | | | | | | |
|---|---|---|---|---|---|---|---|
| − | − | + | + | − | − | + | + |
| + | + | − | − | + | + | − | − |
| − | − | + | + | − | − | + | + |
| + | + | − | − | + | + | − | − |
| − | − | + | + | − | − | + | + |
| + | + | − | − | + | + | − | − |
| − | − | + | + | − | − | + | + |
| + | + | − | − | + | + | − | − |

LIQUID CRYSTAL DISPLAY DEVICE, DRIVING APPARATUS THEREOF AND DRIVING METHOD THEREOF

This application claims the benefit of Korean Patent Application No. 2005-58420 filed in Korea on Jun. 30, 2005 which is hereby incorporated by reference for all purposes as if fully set forth herein.

BACKGROUND OF THE INVENTION

1. Field of the Invention

This invention relates to a liquid crystal display device capable of improving a display quality and a driving method thereof.

2. Discussion of the Related Art

A liquid crystal display (LCD) device controls light transmittance of liquid crystal cells in accordance with data signals applied thereto to thereby display an image. In particular, an active matrix type LCD device includes a switching device for each liquid crystal cell. A thin film transistor (TFT) is typically employed as the switching devices for active matrix type LCD devices. Active matrix type LCD devices have various applications, such as monitors for computers and displays for office equipment and cellular phones.

FIG. 1 is a schematic block diagram showing an apparatus for driving a liquid crystal display device according to the related art.

Referring to FIG. 1, the related art liquid crystal display device includes a liquid crystal display panel 2 where m×n number of liquid crystal cells Clc are arranged in a matrix with m number of data lines D1 to Dm crossing n number of gate lines G1 to Gn; a TFT formed near each of the crossings of a data line and a gate line; a data driver 4 for supplying a data signal to the data lines D1 to Dm; a gate driver 6 for supplying a scan signal to the gate lines G1 to Gn; and a timing controller 8 for controlling the data driver 4 and the gate driver 6.

The liquid crystal display panel 2 includes a plurality of liquid crystal cells Clc arranged in a matrix defined by crossings between the data lines D1 to Dm and the gate lines G1 to Gn. The thin film transistor TFT provided at each liquid crystal cell Clc applies a data signal from the data lines D1 to Dm to the liquid crystal cell Clc in response to a scanning signal from the gate lines G1 to Gn. Further, each liquid crystal cell Clc is provided with a storage capacitor Cst for maintaining the voltage of the liquid crystal cell Clc. The storage capacitor Cst may be formed between the pre-stage gate line and the pixel electrode of the liquid crystal cell Clc or between a common electrode line and the pixel electrode of a liquid crystal cell Clc.

The gate driver 6 sequentially applies a scanning pulse to the gate lines G1 to Gn in response to a control signal CS from the timing controller 8 to thereby select horizontal lines of the liquid crystal display panel 2 to be supplied with the data signals.

The data driver 4 converts digital video data R, G and B into analog gamma voltages, i.e., data signals, corresponding to gray level values of the digital video data in response to the control signal CS from the timing controller 8, and applies the analog gamma voltages to the data lines D1 to Dm.

The timing controller 8 generates the control signal CS for controlling the gate driver 6 and the data driver 4 using synchronizing signals and a clock signal supplied from an external source. The control signal CS for controlling the gate driver 6 includes a gate start pulse GSP, a gate shift clock GSC, and a gate output signal GOE. The control signal CS for controlling the data driver 4 includes a source start pulse SSP, a source shift clock SSC, a source output enable SOC, and a polarity signal POL. The timing controller 8 re-arranges the data Data supplied from the exterior to supply to the data driver 4.

In the related art liquid crystal display device, the liquid crystal cells on the liquid crystal display panel 2 are driven using an inversion driving method such as a frame inversion system, a column inversion system, or a dot inversion system. In the driving method of the frame inversion system, the polarity of the data signals supplied to the liquid crystal cells on the liquid crystal display panel 2 is inverted whenever a frame is changed. In the driving method of the line inversion system, the polarity of the data signals supplied to the liquid crystal cells is inverted for each horizontal row of the liquid crystal display panel 2. In the driving method of the column inversion system, the polarity of the data signals supplied to the liquid crystal cells is inverted for each column of the liquid crystal display panel 2. The dot inversion system has a pixel voltage signal supplied to each given liquid crystal cell having a polarity opposite that of the polarity supplied to the liquid crystal cells that are adjacent to the given liquid crystal cell on the liquid crystal display panel 2 in the vertical and horizontal directions. Further, in the dot inversion system, the polarity of the pixel signals supplied to the liquid crystal cells on the liquid crystal display panel 2 is inverted for every frame.

Among these inversion driving methods, the dot inversion system provides the best picture quality as compared with the frame inversion system, the line inversion system and the column inversion system. The driving of the dot inversion system is performed by controlling the data signals from the data driver 4 in response to the polarity signal POL supplied from the timing controller 8.

Typically, the liquid crystal display device is driven by a frame frequency of 60 Hz. However, a lower frame frequency in the range of 30~50 Hz may be used in systems such as a notebook computers to lower power consumption. As the frame frequency is lowered, a phenomenon where the display presents a greenish color occurs even in the dot inversion system. A horizontal 2-dot inversion system has been proposed for operation at lower frame frequencies as a solution to this greening problem.

Referring to FIG. 2A and FIG. 2B, the horizontal 2-dot inversion system is set to change the polarity every two liquid crystal cells in a horizontal direction and in addition, to invert the liquid crystal cells vertically adjacent to have a polarity different from each other. Further, the polarity of the liquid crystal cells is inverted every frame. The driving method of horizontal 2-dot invention system provides improved picture quality as compared with other inversion methods at lower frame frequencies.

However, in the horizontal 2-dot inversion system, a dominant polarity is generated when displaying images having a specific repeating pattern. The dominant polarity leads to a problem wherein a voltage of a common electrode Vcom is changed.

More specifically, as shown in FIG. 3, when a specific pattern is repeated, the polarity of the liquid crystal cells of a horizontal line is differently set. In other words, in the (+) polarity dominant lines, 8 liquid crystal cells are supplied with positive polarity data signals and 4 liquid crystal cells are supplied with negative polarity data signals. On the other hand, in the (−) polarity dominant lines, 8 liquid crystal cells are supplied with negative polarity data signals and 4 liquid crystal cells are supplied with positive polarity data signals. When a dominant polarity of positive polarity or negative polarity data signals is generated for each line, the voltage of the common electrode is changed causing a brightness deviation between the liquid crystal cells. Accordingly, a smear phenomenon such as crosstalk occurs, thereby lowering display quality.

SUMMARY OF THE INVENTION

Accordingly, the present invention is directed to a liquid crystal display device and driving method thereof that substantially obviates one or more of the problems due to limitations and disadvantages of the related art.

An advantage of the present invention to provide a liquid crystal display device capable of improving a display quality and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes: a liquid crystal display panel in which data lines and gate lines cross and a plurality of liquid crystal cells are arranged; a data discrimination part to detect data in which a dominant polarity is generated; a data driver to shift a polarity of the data in which the dominant polarity is generated in a horizontal direction and to supply the data to the data lines; and a gate driver to sequentially supply a scanning signal to the gate lines.

In another aspect of the present invention, a driving method of the liquid crystal display device includes: detecting data in which a dominant polarity is generated; shifting a polarity of the data in which the dominant polarity is generated in a horizontal direction and supplying it to data lines of a liquid crystal display panel; and sequentially supplying a scanning pulse to gate lines crossing the data lines.

It is to be understood that both the foregoing general description and the following detailed description are exemplary and explanatory and are intended to provide further explanation of the invention as claimed

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 2A and FIG. 2B are views showing a horizontal 2-dot invention driving system of the related art;

DETAILED DESCRIPTION OF THE ILLUSTRATED EMBODIMENTS

Reference will now be made in detail to embodiments of the present invention, examples of which are illustrated in the accompanying drawings.

Figure 5:
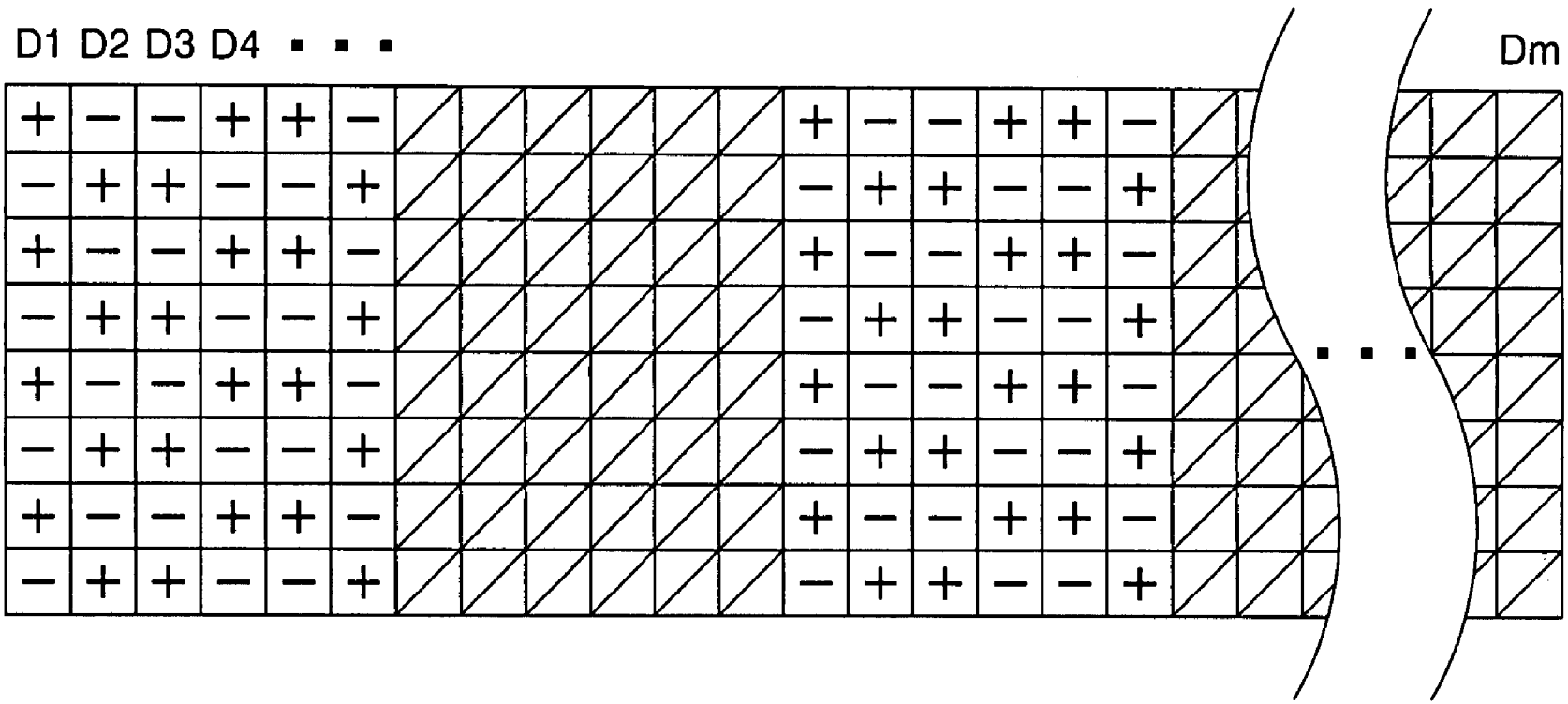
FIG. 5 and FIG. 6 are views of a polarity of the horizontal 2-dot inversion system illustrating removal of the dominant polarity by the data discrimination part shown in FIG. 4
Figure 6:
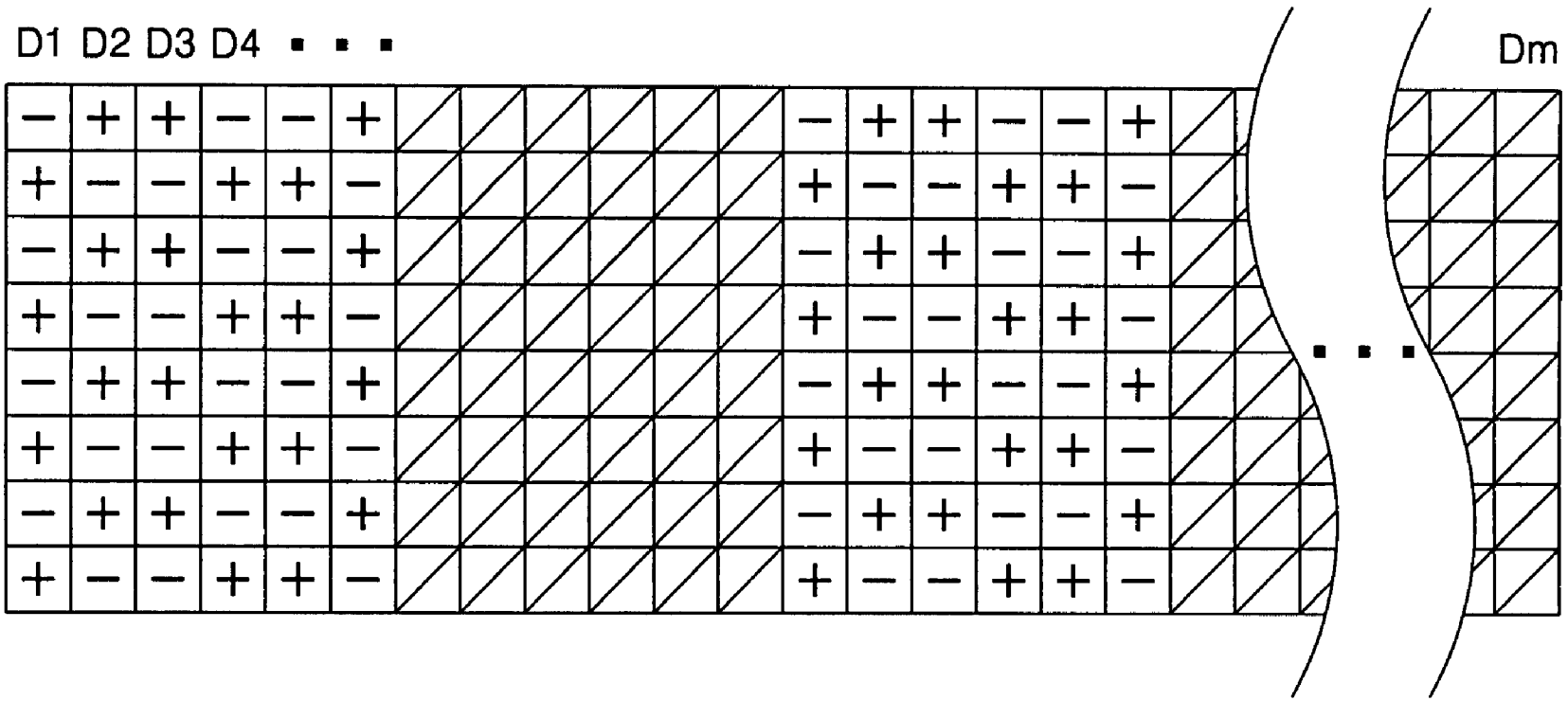

Hereinafter, embodiments of the present invention will be described in detail with reference to FIGS. 4 to 6.

Figure 4:
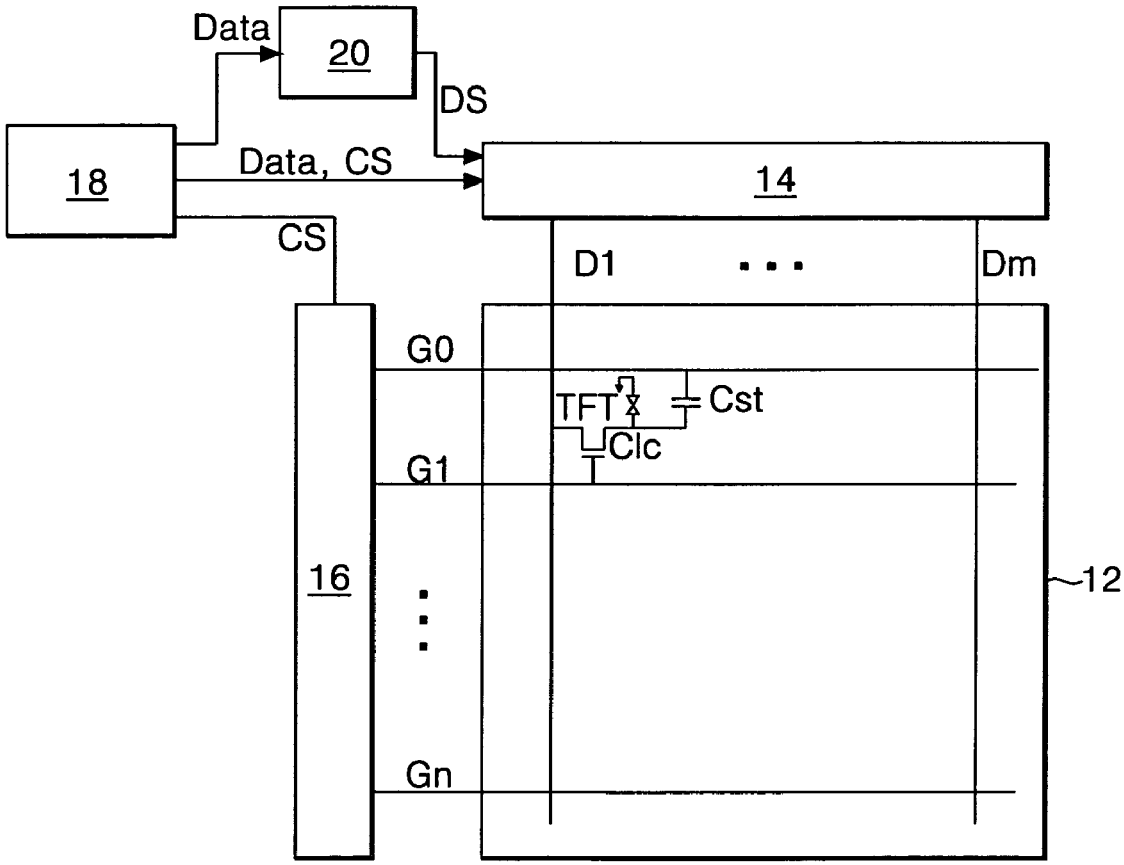
FIG. 4 is a block diagram showing a liquid crystal display device according to an embodiment of present invention.

FIG. 4 is a block diagram showing a liquid crystal display device according to an embodiment of the present invention.

Referring to FIG. 4, the liquid crystal display device according to an embodiment of the present invention includes a liquid crystal display panel 12 where m×n number of liquid crystal cells Clc are arranged in a matrix, m number of data lines D1 to Dm cross n number of gate lines G1 to Gn, and a TFT is formed at each of the crossings between gate and data lines; a data driver 14 for supplying a data signal to the data lines D1 to Dm of the liquid crystal display panel 12; a gate driver 16 for supplying a scan signal to the gate lines G1 to Gn; a timing controller 18 for controlling the data driver 14 and the gate driver 16; and a data discrimination part 20 for discriminating a polarity pattern of the data Data supplied from the timing controller 18.

The liquid crystal display panel 12 includes a plurality of liquid crystal cells Clc arranged in a matrix defined by the crossings between the data lines D1 to Dm and the gate lines G1 to Gn. The thin film transistor TFT provided in each liquid crystal cell Clc applies a data signal from the data lines D1 to Dm to the liquid crystal cell Clc in response to a scanning signal from the gate line G. Further, each liquid crystal cell Clc is provided with a storage capacitor Cst for storing charge to maintain the voltage of the liquid crystal cell Clc. The storage capacitor Cst may be formed between the pre-stage gate line and the pixel electrode of the liquid crystal cell Clc, and alternatively may be formed between a common electrode and the pixel electrode of the liquid crystal cell Clc. The liquid crystal cells Clc of the above described liquid crystal panel 12 are driven by a horizontal 2-dot invention system.

The timing controller 18 generates the control signal CS for controlling the gate driver 16 and the data driver 14 using synchronizing signals and a clock signal supplied from a source external to the liquid crystal display panel. Herein, the control signal CS for controlling the gate driver 16 includes a gate start pulse GSP, a gate shift clock GSC, and a gate output signal GOE. The control signal CS for controlling the data driver 14 includes a source start pulse SSP, a source shift clock SSC, a source output enable SOC, and a polarity signal POL. The polarity signal POL directs the polarity of the data signal to be supplied from the data driver 14 of the horizontal 2-dot inversion system. The timing controller 18 re-arranges the data Data supplied from the exterior and supplies the data to the data driver 14 and the data discrimination part 20.

The gate driver 16 sequentially applies a scanning pulse to the gate lines G1 to Gn in response to a control signal CS from the timing controller 18 to thereby select horizontal lines of the liquid crystal display panel 12 to be supplied with the data signals.

Figure 1:
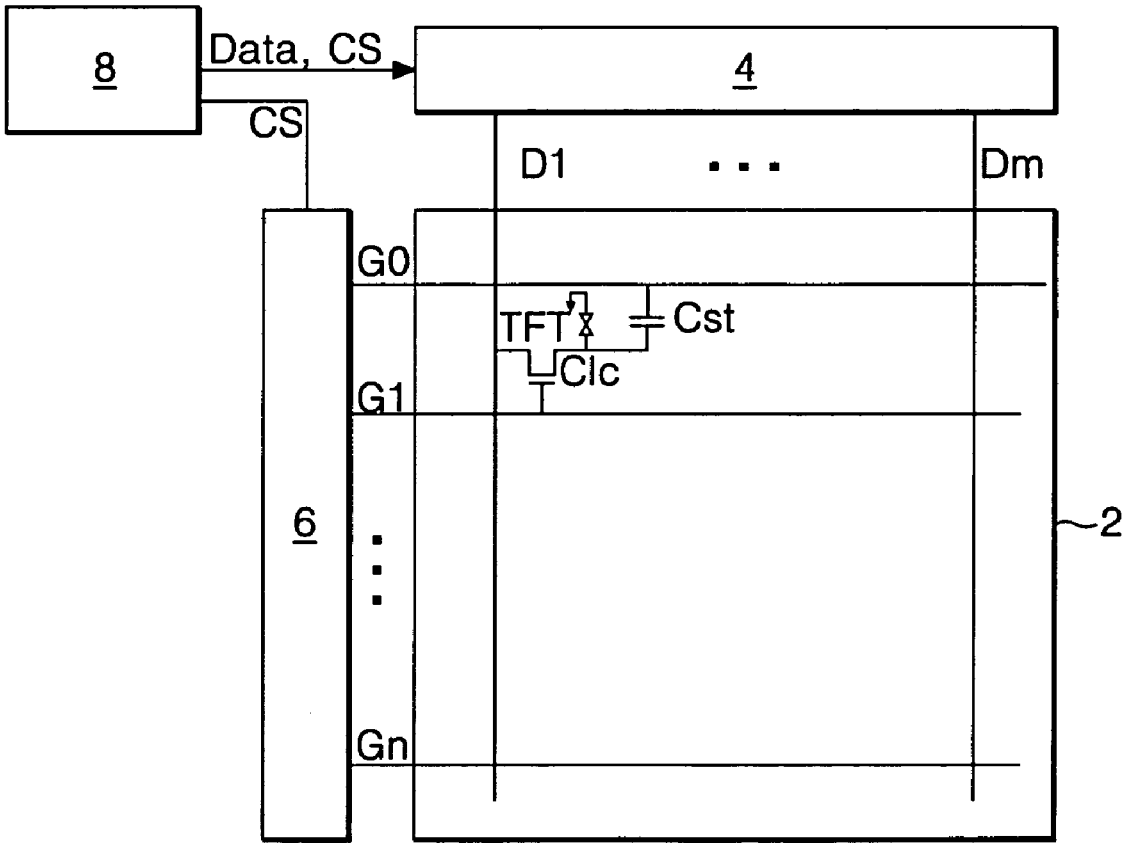
FIG. 1 RELATED ART
FIG. 1 is a schematic block diagram showing a related art liquid crystal display device.
Figure 3:
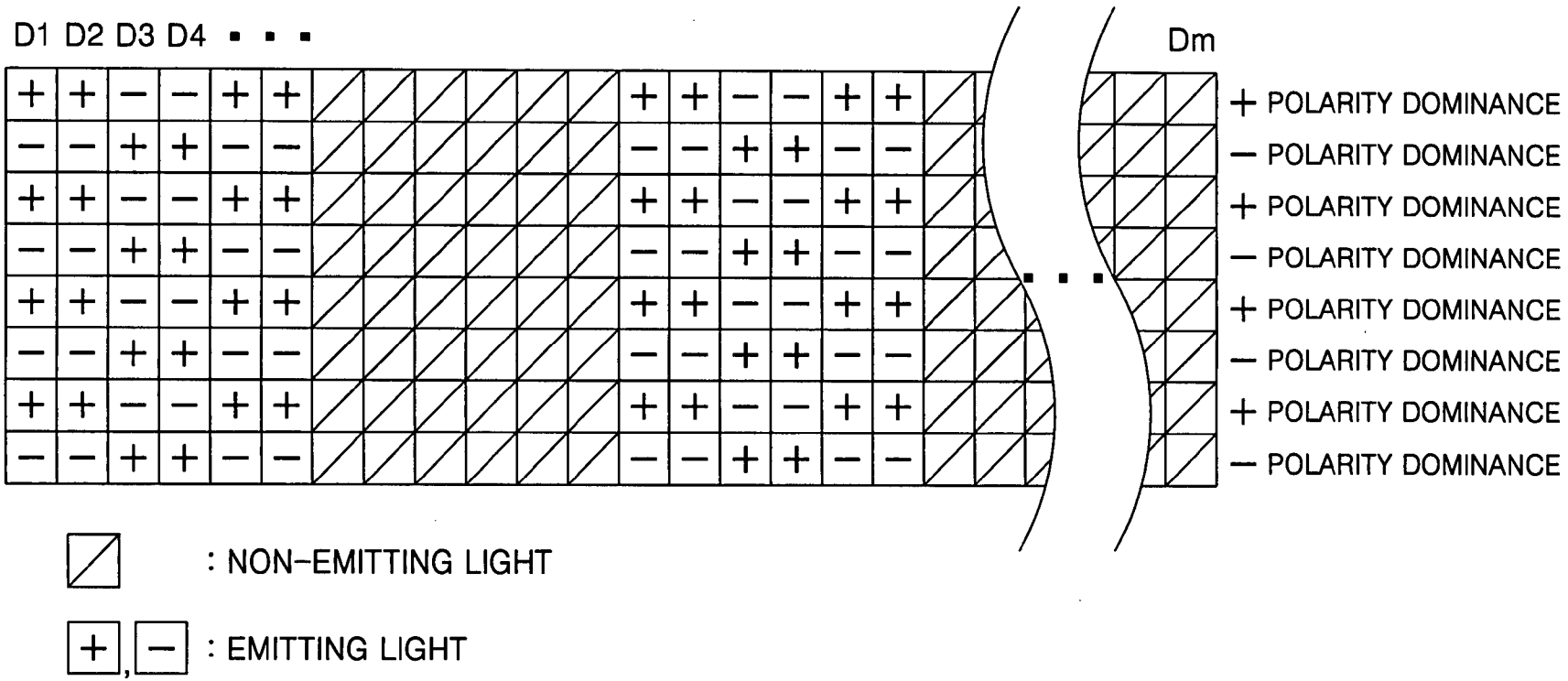
FIG. 3 RELATED ART
FIG. 3 is a view showing an example of a dominant polarity in the horizontal 2-dot invention driving system.

The data discrimination part 20 is supplied with the data Data from the timing controller 18. The data discrimination part 20 detects or discriminates whether or not the present supplied data Data is data in which a dominant polarity is present. A dominant polarity is present if a particular polarity (+) or (−) is generated for more liquid crystal cells of a given horizontal line than is the opposite polarity in the data inputted to the liquid crystal panel 12. The data discrimination part 20 performs the detection or discrimination for each horizontal line as shown in FIG. 3. When the data discrimination part 20 detects that a dominant polarity is generated in the data Data inputted from the timing controller 18 the data discrimination part 20 supplies a detection signal DS to the data driver 14.

The data driver 14 converts digital video data Data into analog gamma voltages, i.e., data signals, corresponding to gray level values in response to the control signal CS from the timing controller 18; inverts a polarity of the data voltage in response to the polarity signal POL; and applies the data voltages to the data lines D1 to Dm. The data driver 14 also shifts the polarity of the data voltages to either the left side or the right side in a horizontal direction by one liquid crystal cell unit in response to the detection signal DS from the data discrimination part 20, but does not shift the magnitudes of the data voltage.

For instance, as shown in FIG. 3, when the data Data being supplied is inputted, the detection signal DS is generated in accordance with the data pattern. The data driver 14 shifts the polarity of the data line to left side as shown in FIG. 5 or to right side as shown in FIG. 6. For example, in the data of an odd frame in which a dominant polarity is not present, the data driver 14 generates data voltages that are supplied to the (4i+1)th (herein i is an integer greater than or equal to 0) data line (D1, D5, . . . Dm−3) and the (4i+2)th data line (D2, D6, . . . Dm−2) as a positive polarity, and generates the data voltages that are supplied to the (4i+3)th data line (D3, D7, . . . Dm−1) and the (4i+4)th data line (D4, D8, . . . Dm) as a negative polarity. In the data of an odd frame in which a dominant polarity is present, the data driver 14 shifts the polarity of the data to left side by one liquid crystal cell unit as shown in FIG. 5 in response to the detection signal DS to generate data voltages that are supplied to the (4i+1)th data line (D1, D5, . . . Dm−3) as a positive polarity, to generate data voltages that are supplied to the (4i+2)th data line (D2, D6, . . . Dm−2) and the (4i+3)th data line (D3, D7, . . . Dm−1) as a negative polarity, and to generate data voltages that are supplied to the (4i+4)th data line (D4, D8, . . . Dm) as a positive polarity.

In this way, when the data Data that generates a dominant polarity is inputted, polarities of the data signal are shifted to the horizontal direction by one liquid crystal cell unit. Thereby, the number of the positive polarity signal becomes equal to the number of the negative data signal for each line as shown in FIG. 5 and FIG. 6 so as not to generate a dominant polarity. Accordingly, a brightness difference and a smear phenomenon can be eliminated improving display quality.

As described above, according to the liquid crystal display device of the embodiment of the present invention and the driving method thereof, when the data that generates a dominant polarity is inputted, only the polarity of the data voltage is shifted while the magnitude of the data voltage is maintained not shifted. Accordingly, it is possible to display an image without a dominant polarity. As a result, a brightness difference and a smear phenomenon are prevented in the 2-dot inversion system and display quality is improved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving method of the liquid crystal display device including a liquid crystal display panel according to a horizontal 2-dot inversion system comprising:

detecting data corresponding to gray level values in which a dominant polarity is generated;

shifting a polarity of the data in which the dominant polarity is generated in a horizontal direction and supplying the data to data lines of a liquid crystal display panel; and sequentially supplying a scanning pulse to gate lines crossing the data lines, wherein the polarity of the data shifts to a left side or right side in the horizontal direction in response to the dominant polarity signal, wherein a number of a positive polarity of the data becomes equal to a number of a negative polarity of the data for each data line, wherein the dominant polarity is a particular polarity which is generated in the horizontal direction for more liquid crystal cells than the opposite polarity in the data inputted to the liquid crystal panel.

2. The driving method of the liquid crystal display device according to claim 1, wherein the shifting the polarity of the data includes shifting the polarity of the data while maintaining magnitudes of the voltage of the data unshifted.

3. The driving method of the liquid crystal display device according to claim 1, wherein detecting data in which a dominant polarity is generated includes generating a dominant polarity signal when a dominant polarity is detected.

4. The driving method of the liquid crystal display device according to claim 1, wherein detecting data in which a dominant polarity is generated includes detecting a dominant polarity in data for a horizontal line of the liquid crystal display panel.

5. A liquid crystal display device comprising:

a liquid crystal display panel in which data lines and gate lines cross and a plurality of liquid crystal cells are arranged;

a data discrimination part to detect data corresponding to gray level values in which a dominant polarity is generated;

a data driver to shift a polarity of the data in which the dominant polarity is generated in a horizontal direction and to supply the data to the data lines, and is arranged to drive the liquid crystal display panel in a horizontal 2-dot inversion system; and a gate driver to sequentially supply a scanning signal to the gate lines, wherein the polarity of the data shifts to a left side or a right side in the horizontal direction in response to the dominant polarity signal, wherein a number of a positive polarity of the data becomes equal to a number of a negative polarity of the data for each data line, wherein the dominant polarity is a particular polarity which is generated in the horizontal direction for more liquid crystal cells than the opposite polarity in the data inputted to the liquid crystal panel.

6. The liquid crystal display device according to claim 5, wherein the data driver is arranged to maintain a magnitude of the data voltages unshifted.

7. The liquid crystal display device according to claim 5, wherein the data driver is arranged to shift a polarity of the data in which the dominant polarity is generated in a horizontal direction by one liquid crystal cell.

8. A driving apparatus of a liquid crystal display panel according to a horizontal 2-dot inversion system comprising:

a data discrimination part to detect data in which a dominant polarity is generated in a horizontal line of a liquid crystal display panel; and a data driver to shift a polarity of the data corresponding to gray level values in which the dominant polarity is generated in a horizontal direction on the horizontal line and to supply the data to data lines, wherein the polarity of the data shifts to a left side or a right side in the horizontal direction in response to the dominant polarity signal, wherein a number of a positive polarity of the data becomes equal to a number of a negative polarity of the data for each data line, wherein the dominant polarity is a particular polarity which is generated in the horizontal direction for more liquid crystal cells than the opposite polarity in the data inputted to the liquid crystal panel.

9. The driving apparatus of the liquid crystal display panel according to claim 8, wherein the data driver is arranged to shift polarity of the data and to maintain the magnitude of the data voltage unshifted.

10. The driving apparatus of the liquid crystal display panel according to claim 8, wherein the data driver is arranged to shift a polarity of the data in which the dominant polarity is generated in the horizontal line of the liquid crystal display panel by one liquid crystal cell position in a horizontal direction.

11. The driving apparatus of the liquid crystal display panel according to claim 8, wherein a data discrimination part is arranged to generate a dominant polarity signal when a dominant polarity is present in data for a horizontal line of the liquid crystal display panel.

12. A driving method of the liquid crystal display device comprising:

detecting data corresponding to gray level values in which a dominant polarity is generated;

shifting a polarity of the data in which the dominant polarity is generated in a horizontal direction in response to a detection signal while maintaining magnitudes of the voltage of the data unshifted and supplying it to data lines of a liquid crystal display panel; and sequentially supplying a scanning pulse to gate lines crossing the data lines, wherein in the data of an odd frame in which the dominant polarity is not present, the data driver generates data voltages that are supplied to a 4i+1th data line and a 4i+2th data line as a positive polarity, and generates the data voltages that are supplied to a 4i+3th data line and a 4i+4th data line as a negative polarity, wherein in the data of the odd frame in which the dominant polarity is present, the data driver shifts the polarity of the data to a left side by one liquid crystal cell unit in response to the detection signal to generate data voltages that are supplied to a 4i+1th data line as a positive polarity, to generate data voltages that are supplied to a 4i+2th data line and a 4i+3th data line as a negative polarity, and to generate data voltages that are supplied to a 4i+4th data line as a positive polarity, and wherein i is an integer greater than or equal to zero.

* * * * *